US008925542B2

(12) United States Patent
White et al.

(10) Patent No.: US 8,925,542 B2
(45) Date of Patent: Jan. 6, 2015

(54) SLOW OPEN AND/OR SLOW CLOSE HINGE ASSEMBLY AND HINGE SYSTEM

(75) Inventors: Brian White, Shelby, OH (US); James Collene, Bucyrus, OH (US)

(73) Assignee: Mansfield Assemblies Co., Mansfield, OH (US)

( * ) Notice: Subject to any disclaimer, the term of this patent is extended or adjusted under 35 U.S.C. 154(b) by 1015 days.

(21) Appl. No.: 12/840,743

(22) Filed: Jul. 21, 2010

(65) Prior Publication Data

US 2011/0017191 A1 Jan. 27, 2011

Related U.S. Application Data

(60) Provisional application No. 61/227,262, filed on Jul. 21, 2009.

(51) Int. Cl.
*F24C 15/02* (2006.01)
*E05F 1/12* (2006.01)

(52) U.S. Cl.
CPC ..... *F24C 15/023* (2013.01); *E05F 1/1261* (2013.01); *E05Y 2900/308* (2013.01)
USPC ..... 126/194; 126/190; 16/277

(58) Field of Classification Search
USPC ..... 126/194, 198, 190; 16/221, 392, 277; 312/326, 319.2
See application file for complete search history.

(56) References Cited

U.S. PATENT DOCUMENTS

| | | | | |
|---|---|---|---|---|
| 1,228,042 | A * | 5/1917 | O'Dowd | 126/190 |
| 1,253,376 | A * | 1/1918 | Hick | 16/358 |
| 3,712,287 | A * | 1/1973 | Summers, Jr. | 126/191 |
| 6,041,548 | A | 3/2000 | Miller | |
| 6,397,836 | B1 * | 6/2002 | Pelletier et al. | 126/194 |
| 6,789,293 | B2 * | 9/2004 | Habegger et al. | 16/343 |
| 6,845,545 | B2 * | 1/2005 | Han et al. | 16/277 |
| 7,676,888 | B2 | 3/2010 | Vanini | |
| 2006/0032019 | A1 * | 2/2006 | Kistner et al. | 16/286 |
| 2008/0201907 | A1 * | 8/2008 | Vanini | 16/342 |
| 2008/0289144 | A1 | 11/2008 | Vanini | |
| 2010/0148646 | A1 * | 6/2010 | Bettinzoli | 312/326 |
| 2011/0146654 | A1 * | 6/2011 | Basavalingappa Mudbasal et al. | 126/194 |
| 2011/0146655 | A1 * | 6/2011 | Basavalingappa Mudbasal et al. | 126/194 |
| 2011/0148262 | A1 * | 6/2011 | Basavalingappa Mudbasal et al. | 312/319.2 |

FOREIGN PATENT DOCUMENTS

| | | |
|---|---|---|
| DE | 29 39 727 | 4/1981 |

* cited by examiner

*Primary Examiner* — John K Fristoe, Jr.
*Assistant Examiner* — Umashankar Venkatesan
(74) *Attorney, Agent, or Firm* — Fay Sharpe LLP

(57) ABSTRACT

A damped hinge assembly includes a hinge arm adapted to be connected to an associated appliance body. A channel is pivotally connected to the hinge arm and is adapted to be connected to an associated appliance door. A damper is operatively connected between the channel and the hinge arm. The damper includes a body defining a bore and a piston slidably received in the bore. A rod is connected to the piston and projects outward from the bore. A damper fluid is contained in the bore and acts on the piston to dampen sliding movement of the piston in at least one direction in the bore. A spring is located in the bore and acts on the piston to bias the piston toward one end of the bore. An oven or other appliance includes at least one damped hinge assembly. The appliance can include two damped hinge assemblies, each with or without the spring, arranged such that one hinge assembly provides damping primarily during opening of the appliance door and the other hinge assembly provides damping primarily during closing of the appliance door.

30 Claims, 9 Drawing Sheets

SLOW OPEN AND/OR SLOW CLOSE HINGE ASSEMBLY AND HINGE SYSTEM

CROSS-REFERENCE TO RELATED APPLICATION

This application claims priority from and benefit of the filing date of U.S. provisional patent application Ser. No. 61/227,262 filed Jul. 21, 2009, and said provisional patent application is hereby expressly incorporated by reference into the present specification.

BACKGROUND

Damped hinge assemblies for oven doors and other appliance applications are known. One drawback associated with many of these prior systems is their specialized size and/or structure that requires modified installation as compared to conventional undamped hinge assemblies. Other known damped hinge systems have not provided the required performance and/or are not easily modified to tune the appliance door opening/closing characteristics. Based upon the above drawbacks and others associated with known damped hinge assemblies, it has been deemed desirable to provide a damped hinge assembly that overcomes the above-noted deficiencies and others.

SUMMARY

In accordance with one aspect of the present development, an oven includes a body defining a cooking chamber. First and second hinge assemblies are located on respective first and second opposite sides of the body. A door is pivotally connected to the body by the first and second hinge assemblies. The door is movable between a closed position where it closes a mouth of the cooking chamber and an opened position where it opens a mouth of the cooking chamber. Each hinge assembly includes a hinge arm and a channel pivotally connected to the hinge arm. The hinge arm of each hinge assembly is connected to the body and the channel of each hinge assembly is connected to the door. At least one of the first and second hinge assemblies is a damped hinge assembly including a damper operatively connected between the channel and the hinge arm. The damper comprises a body defining a bore. A piston is slidably received in the bore, and a rod is connected to the piston and projects outward from the bore. A damper fluid is contained in the bore and acts on the piston to dampen sliding movement of the piston in at least one direction in said bore. A spring is located in the bore and acts on the piston to bias the piston toward one end of the bore.

In accordance with another aspect of the present development, a damped hinge assembly includes a hinge arm adapted to be connected to an associated appliance body. A channel is pivotally connected to the hinge arm and is adapted to be connected to an associated appliance door. A damper is operatively connected between the channel and the hinge arm. The damper includes a body defining a bore and a piston slidably received in the bore. A rod is connected to the piston and projects outward from the bore. A damper fluid is contained in the bore and acts on the piston to dampen sliding movement of the piston in at least one direction in the bore. A spring is located in the bore and acts on the piston to bias the piston toward one end of the bore.

DETAILED DESCRIPTION OF PREFERRED EMBODIMENTS

Figure 1:
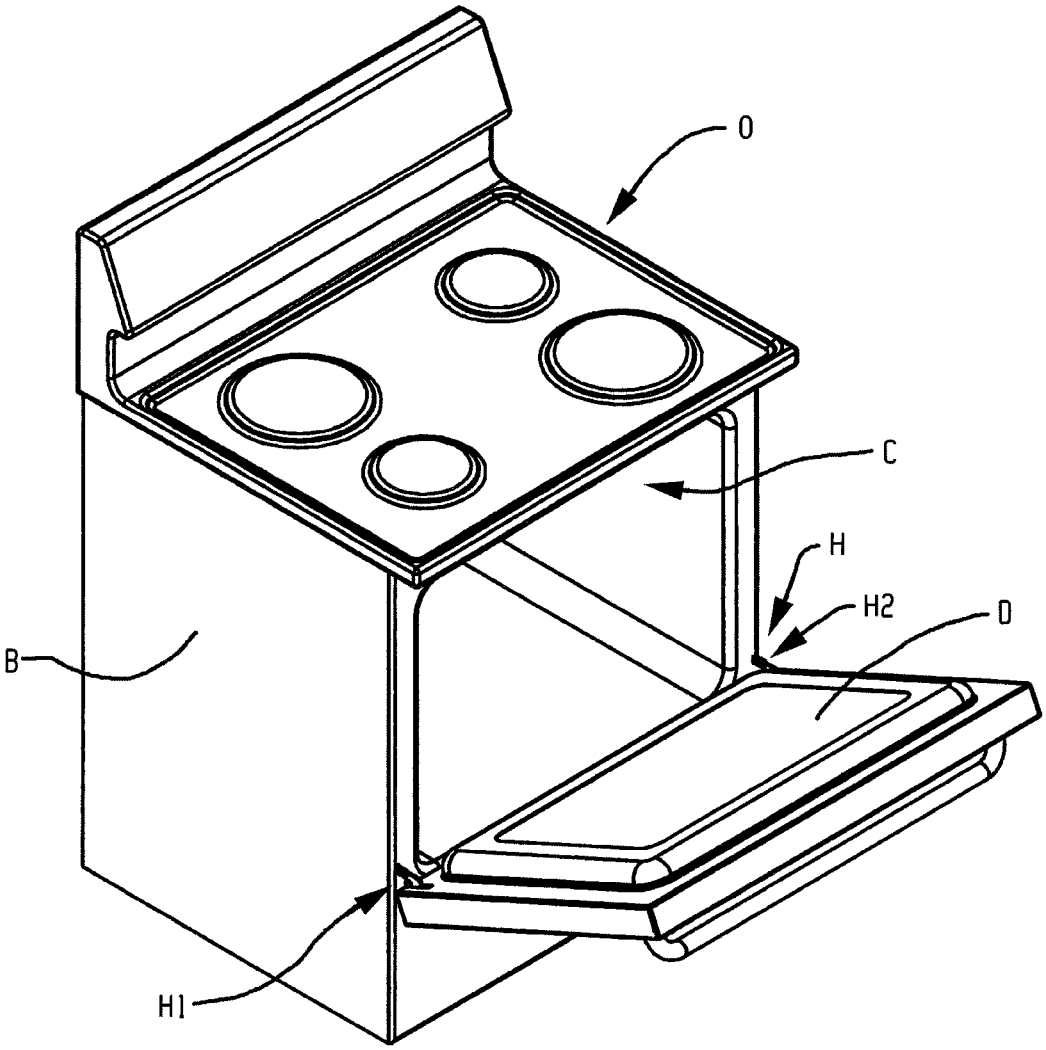
FIG. 1 shows an oven including a slow open and/or slow close hinge system in accordance with the present development, including first and second hinge assemblies.

FIG. 1 shows an oven O including a slow open and/or slow close hinge system H in accordance with the present development. Other than the hinge system H, the oven O is conventional and includes a body B defining a cooking chamber C, and a door D that is pivotally connected to the body B by the hinge system H. The door D is selectively manually movable between opened and closed positions to open and close the mouth of the cooking chamber, respectively, by pivoting movement about a horizontal pivot axis.

The hinge system H in accordance with the present development comprises first and second hinge assemblies H1,H2 located on respective first and second opposite lateral sides of the oven body B and cooking chamber C. In some embodiments, both hinge assemblies H1,H2 are damped hinge assemblies constructed in accordance with the present development, while in other embodiments, one or the other of the hinge assemblies is a damped hinge assembly constructed in accordance with the present development, while the other hinge assembly is a conventional undamped hinge assembly.

Figure 1A:
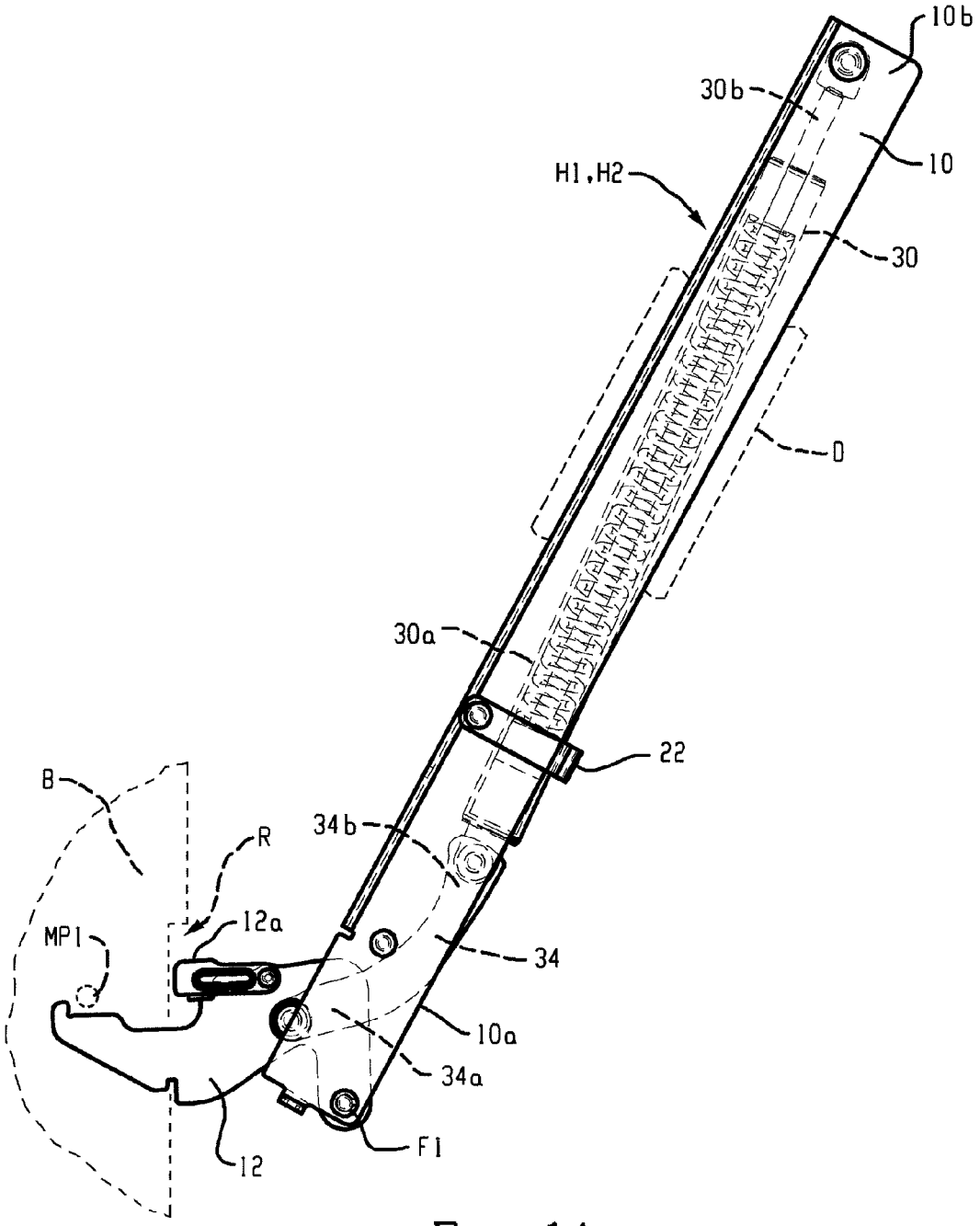
FIG. 1A is provided to show the general arrangement for mounting the first and second hinge assemblies to the oven body and door.

FIG. 1A is provided to show the general arrangement for mounting the hinge assemblies H1,H2 to the oven body B and door D. FIG. 1A shows that the hinge assemblies H1,H2 each include an elongated channel 10 that has an inner end 10*a* pivotally connected to a hinge arm 12 by a first rivet or other fastener F1. The channel 10 is connected to the oven door D, typically between inner and outer faces of the door. The hinge arm 12 is received into and mated with a corresponding receptacle R provided on the oven body B so that the hinge arm 12 is retained in the receptacle R but is selectively removable therefrom as needed. In the illustrated example, the hinge arm engages at least one mounting pin or rivet MP1 located in the receptacle R. A latch 12*a* is pivotally connected to the hinge arm 12 and is selectively pivotable or otherwise movable between a latched (shown) and unlatched position. When the latch 12*a* is in its latched position, it is located to obstruct movement (e.g., upward movement) of the hinge arm 12 relative to the oven body B as is required to disconnect the hinge arm 12 from the receptacle R so as to reduce the chance for unintended disconnection of the hinge arm 12 from the receptacle R. With the first and second hinge assemblies operatively connected between the oven door D and the oven body B, the oven door D is able to be manually pivoted about a horizontal pivot axis defined by the first fastener F1 between a closed position, in which the door D is positioned to enclose the cooking chamber C, and an opened position, in which the door D is positioned to allow access to the cooking chamber C (the door D is shown in a partially opened or intermediate position between fully opened and closed in FIGS. 1 and 1A). When the oven door D is in its closed position, the first and second hinge assemblies H1,H2 are arranged in a first operative position, when the oven door D is in its opened position, the first and second hinge assemblies H1,H2 are arranged in a second operative position, and when the door D is located in an intermediate position between its closed and opened positions, the first and second hinge assemblies are correspondingly located in an intermediate position. Pivoting movement of the oven door D in a first direction about its pivot axis from its closed position toward its opened position is associated with pivoting movement of the channel 10 of each hinge assembly H1,H2 in the first direction about the first fastener F1, and pivoting movement of the oven door D in a second direction about its pivot axis from its opened position toward its closed position is associated with pivoting movement of the channel 10 of each hinge assembly H1,H2 in the second direction about the first fastener F1.

Figure 2:
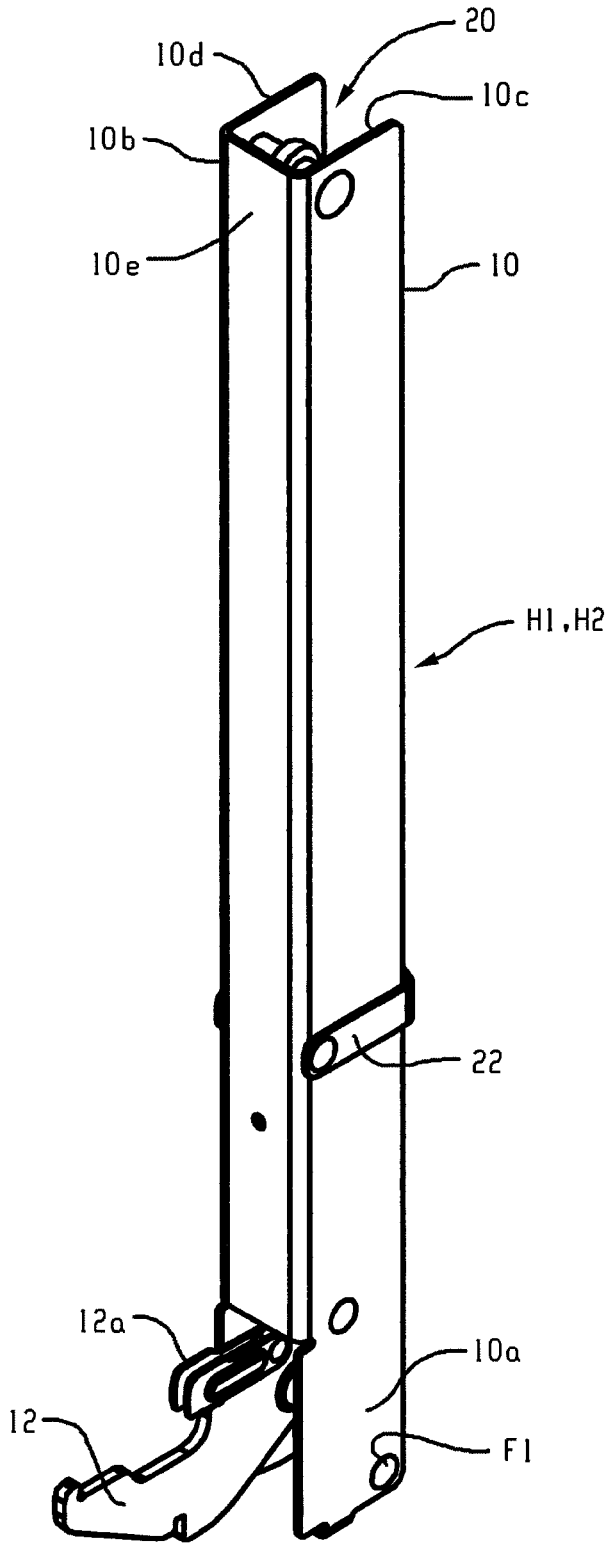
FIGS. 2 and 3 are respective first and second isometric views a damped hinge assembly formed in accordance with the present development, with the hinge assembly in its first position corresponding to the closed position of the oven door.
Figure 3:
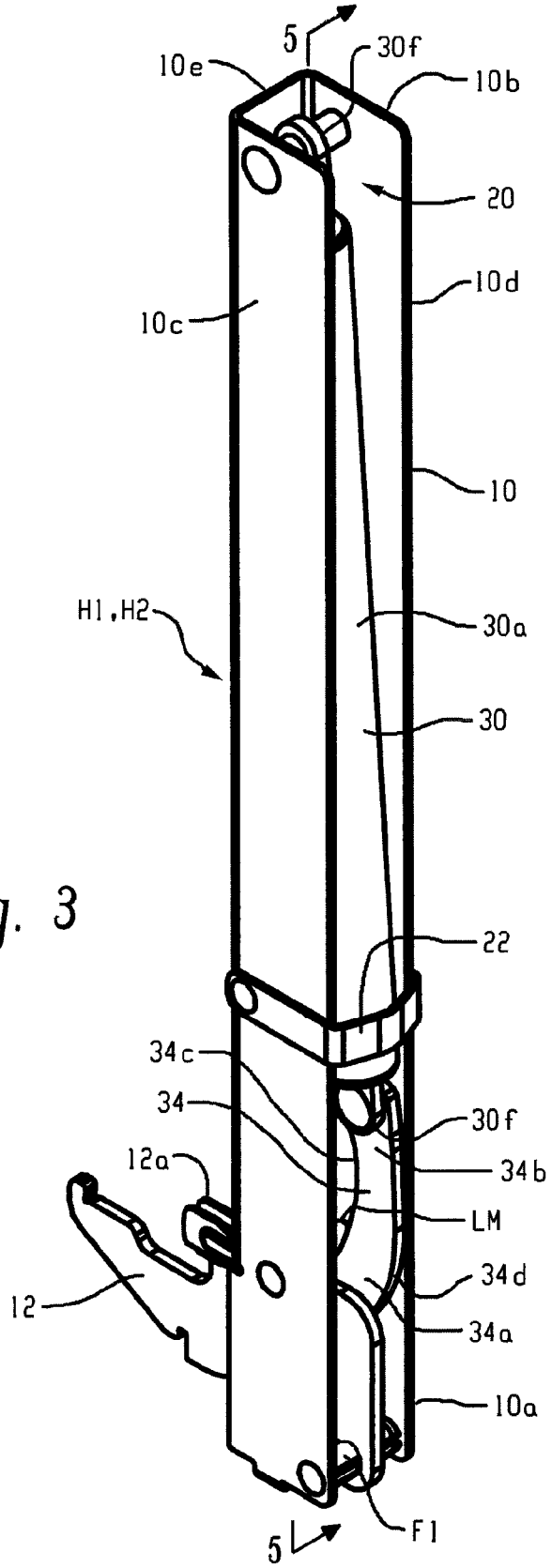
Figure 4:
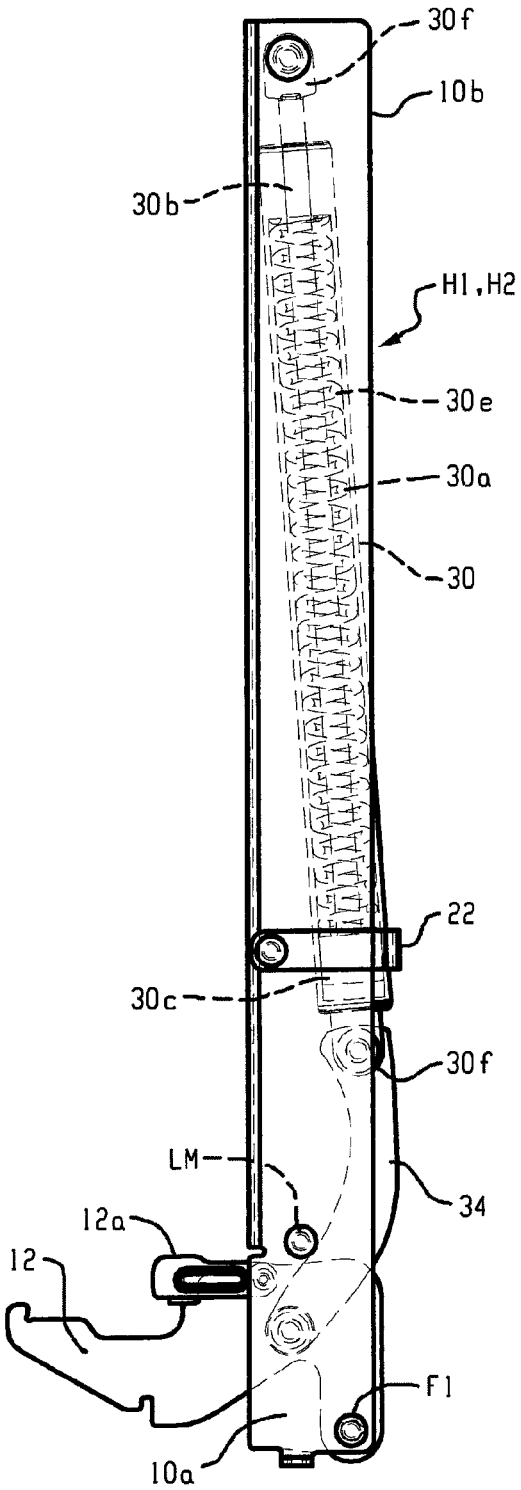
FIG. 4 is a side view of a hinge assembly formed in accordance with the present development, with hidden components shown in broken lines.
Figure 5:
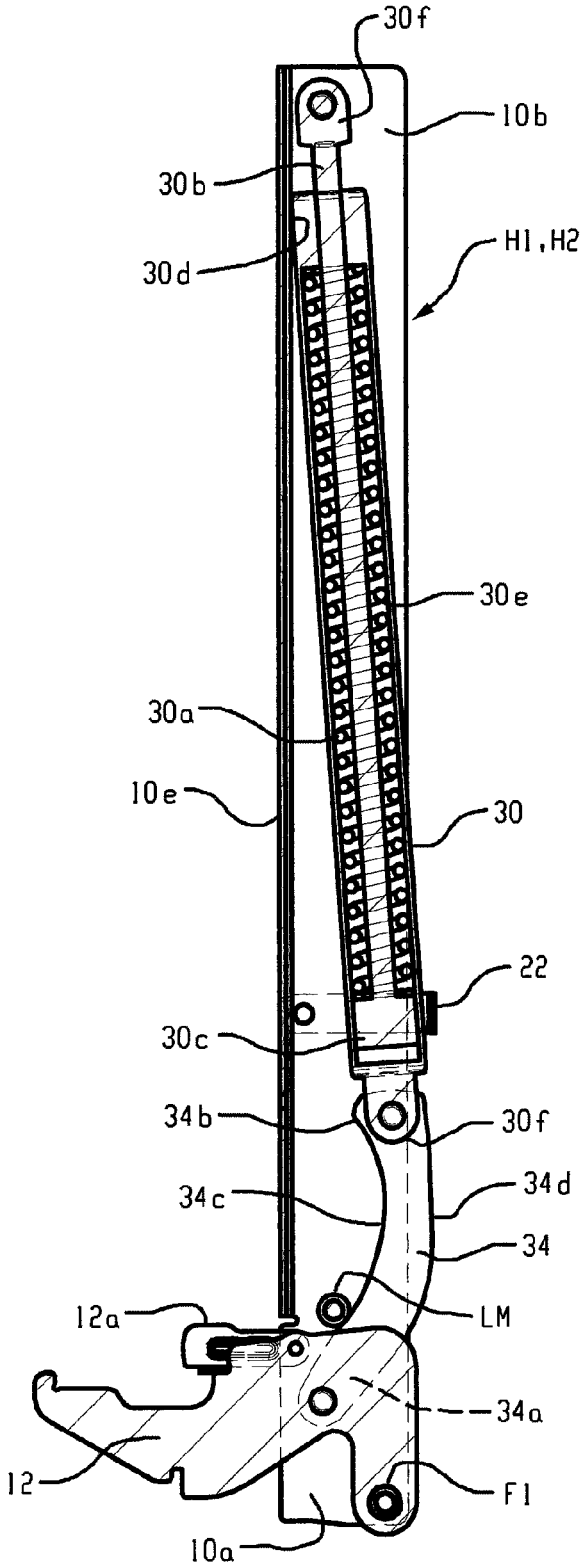
FIG. 5 is a section view as taken along line 5-5 of FIG. 3.
Figure 6:
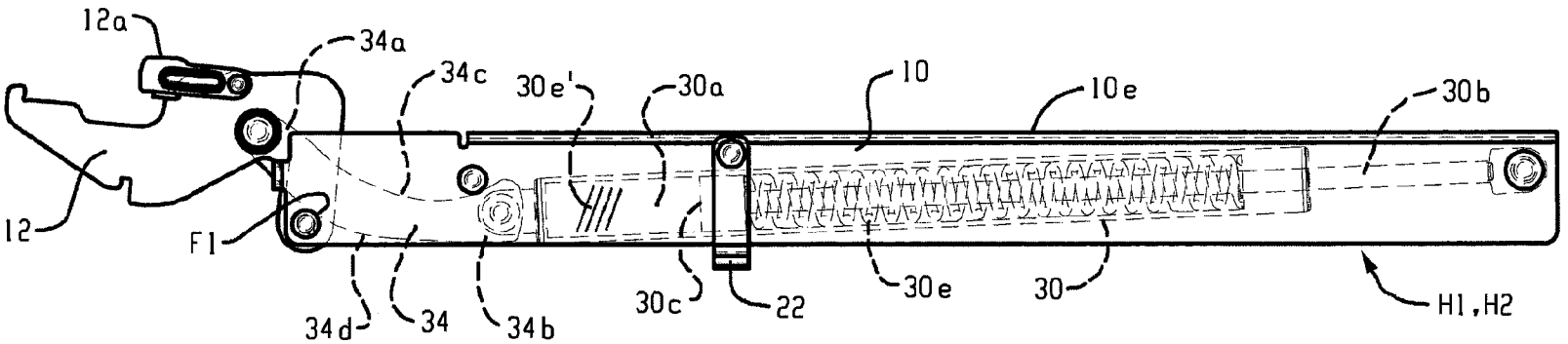
FIGS. 6 and 7 correspond to FIGS. 4 and 5 but show the hinge assembly in its second position corresponding to the opened position of the oven door D.
Figure 7:
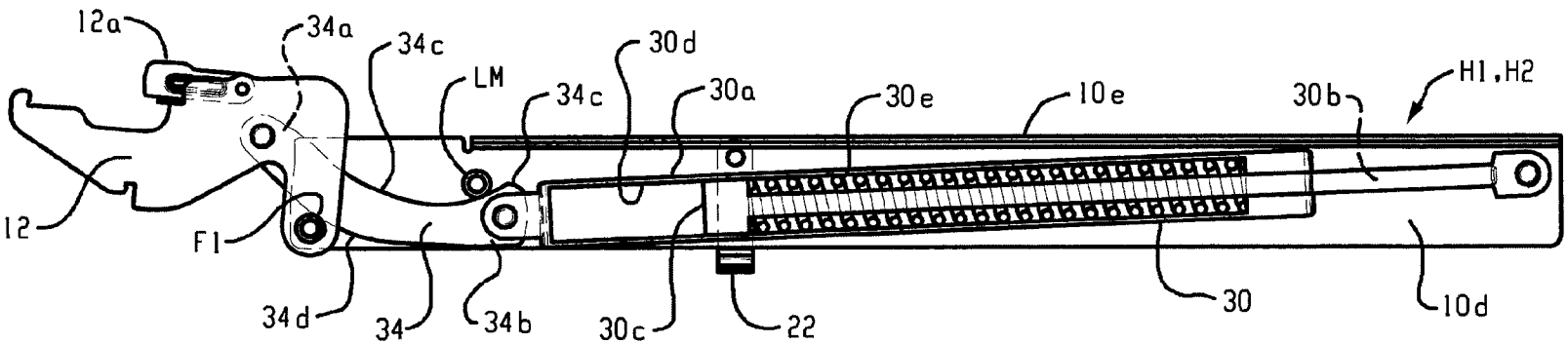

FIGS. 2 and 3 are respective first and second isometric views a hinge assembly H1,H2 formed in accordance with the present development, with the hinge assembly H1,H2 in its first position corresponding to the closed position of the oven door D. FIG. 4 is a side view of the hinge assembly H1,H2 with hidden components shown in broken lines, and FIG. 5 is a section view as taken along line 5-5 of FIG. 3. FIGS. 6 and 7 correspond to FIGS. 4 and 5, but show the hinge assembly H1,H2 in its second position corresponding to the opened position of the oven door D.

It can be seen that the channel 10 includes a first or inner end 10*a* connected to the hinge arm 12 by the first fastener 12, and a second or outer end 10*b* that is spaced from the first end 10*a*. The channel 10 is defined with a U-shaped or other cross-section including opposite side walls 10*c*,10*d* and a transverse end wall 10*e* that extends between and interconnects the side walls 10*c*,10*d*, so that a recess 20 is defined between the walls 10*c*,10*d*,10*e*. The first fastener F1 is connected to and extends between the opposite side walls 10*c*, 10*d* and extends through an aperture defined in the hinge arm 12 to pivotally connect the hinge arm 12 to the inner end 10*a* of the channel. The end wall 10*e* of the channel 10 defines a notch or other opening 10*f* through which the hinge arm 12 projects. The channel 10 and hinge arm 12 are typically defined from a metal such as steel and are manufactured as respective one-piece stampings.

A damper 30 is operably connected between the channel 10 and the hinge arm 12 to damp and control the pivoting movement of the channel 10 relative to the hinge arm 12. In the illustrated embodiment, the damper 30 is operably connected to the hinge arm 12 through at least one link 34, but the damper 30 can alternatively be connected directly to the hinge arm 12. As shown, the link 34 is a single link member defined from a metal stamping or the like. The link 34 includes a first or inner end 34*a* pivotally connected to the hinge arm 12 and a second or outer end 34*b* pivotally connected to the damper 30. In another embodiment, for added strength, the single link 34 is replaced by first and second links 34 that can be identical to each other or that can be shaped differently relative to each other, and that are arranged parallel to each other or that are otherwise arranged relative to each other.

The damper 30 is a fluid (i.e., liquid or gas) damper such as a hydraulic oil or gas spring or pneumatic spring including a body 30*a* and a rod 30*b*. As is generally known in the mechanical arts, a hydraulic or gas spring such as fluid damper 30 includes a piston 30*c* located in a cylindrical bore 30*d* defined in the body 30*a*, and the piston 30*c* is adapted to reciprocate slidably in the bore 30*d*. The rod 30*b* is connected to and moves with the piston 30*c*. The rod 30*b* projects outward from an outer end of the body 30*a* and bore 30*d*. The bore 30*d* contains a damping fluid such as air, gas, hydraulic oil or other liquid sealed therein. The damping fluid damps sliding movement of the piston 30*c* in the bore 30*d* in one direction only (during either extension or retraction of the rod 30*b*) or in both directions (during both extension and retraction of the rod 30*b*) as desired and selected for a particular oven application and, in either case, the damping fluid damps sliding movement of the piston 30*c* over the entire stroke of the piston 30*c* in the bore 30*d* or only during one part or multiple different parts of the stroke of the piston 30*c* in the bore 30*d* such that damping of the piston movement occurs during only these one or more parts of the stroke of the piston 30*c* in the bore 30*d*. Damping sliding movement of the piston 30*c* during only one part or during multiple separate parts of its stroke in the bore 30*d* can accomplished by including structures in the bore 30*d* that interact with the piston 30*c* only during the part(s) of the piston stroke where damping is desired. The fluid contained in the bore 30*d* can be compressed and sealed on one side of the piston or otherwise pressurized in the bore 30*d* so as to bias the piston 30*c* in one direction or the other, or the fluid can flow through the piston 30*c* to dampen piston movement without biasing the piston 30*c* in any direction. In the illustrated embodiment, a separate coil spring or other biasing spring 30*e* is located in the bore 30*d* and arranged coaxially around the rod 30*b* to bias the piston 30*c* toward one end of the bore 30*d*. As shown in the illustrated embodiment, spring 30*e* biases the piston 30*c* toward an inner end of the bore 30*d* where the piston 30*c* is located when the rod 30*b* is retracted into the bore 30*d* (corresponding to a closed position of the oven door D). The spring 30*e* can be alternatively positioned in the bore 30*d* to bias the piston 30*c* toward the outer end of the body 30*a* as shown at 30*e*' in FIG. 6.

The damper 30 is located in the recess 20 of the channel 10, with either its body 30*a* or rod 30*b* pivotally connected directly or through another structure to the outer end 10*b* of the channel 10 so as to move with the channel 10 during opening and closing of the oven door D. If the rod 30*b* is connected to the outer end 10*b* of the channel (as shown herein), the body 30*a* is pivotally connected to the link(s) 34 (or directly to the hinge arm 12). On the other hand, if the body 30*a* is connected to and moves with the outer end 10*b* of the channel, the rod 30*b* is pivotally connected to the link(s) 34 (or directly to the hinge arm 12). In either case, the damper 30 is connected at one of its ends directly or indirectly to the channel 10 and is connected at the other of its ends directly or indirectly to the hinge arm 12. The body and rod 30*a*,30*b* include respective mounting tabs 30*f* to facilitate connection to the channel 10 and link 34 (or hinge arm 12) using rivets, pins or other suitable fasteners as shown.

Comparing FIGS. 4 and 5 with FIGS. 6 and 7, one of ordinary skill in the art will recognize that pivoting movement of the channel 10 from its first position (FIGS. 4 and 5) to its second position (FIGS. 6 and 7) causes the damper rod 30*b* to be extended relative to the housing 30*a* with corresponding outward sliding movement of the piston 30*c* in the bore 30*d* against the biasing force of the spring 30*e*, which results in compression of the spring 30*e*. Conversely, pivoting movement of the channel 10 from its second position to its first position causes the damper rod 30*b* to be retracted into the housing 30*a* with corresponding inward sliding movement of the piston 30*c* in the bore 30*d*, and the spring 30*e* will resiliently elongate to assist this movement due to it biasing force exerted on the piston 30*c*.

Referring primarily to FIGS. 3, 5 and 7, the at least one link 34 includes first and second edges 34*c*,34*d*. A link control member LM is connected to the channel 10 and spans or is otherwise located in the recess 20 so as to be adjacent and preferably in continuous contact with the first link edge 34*c* to control the position and movement of the link 34 during opening and closing of the oven door D. In particular, the first link edge 34*c* is in sliding contact with the link control member LM during opening and closing of the oven door D. Also, contact between the first link edge 34*c* and the link control member LM when the oven door D is in its closed position provides increased mechanical advantage for pulling the oven door closed, i.e., for urging the channel 10 toward its first position. In the illustrated embodiment, the link control member LM is provided by a rivet or other fastener connected to and extending between the channel side walls 10*c*,10*d*. An optional roller or bushing can be carried on the link control member LM in the recess to facilitate relative sliding or other movement between the first link edge 34*c* and the link control member LM. The first link edge 34*c* can define a hook or other dwell point (not shown) adjacent the outer end 34*b* of the link 34 that is adapted to receive and retain the link control member LM when the channel is moved fully to its second (door opened) position, which prevents further pivoting movement of the channel 10 away from its first position (door closed) beyond its second (door opened) position. Additionally or alternatively, the first fastener F1 that pivotally connects the channel 10 to the hinge arm 12 (or another fastener) defines a stop that is abutted by the second link edge 34*d* when the channel 10 is moved fully to its second (door opened) position, which limits further pivoting movement of the channel 10 away from its first (door closed) position as shown in FIGS. 6 and 7. If the link 34 is omitted and the damper 30 connected directly to the hinge arm 12, the link control member LM becomes superfluous and can be omitted.

Figure 4A:
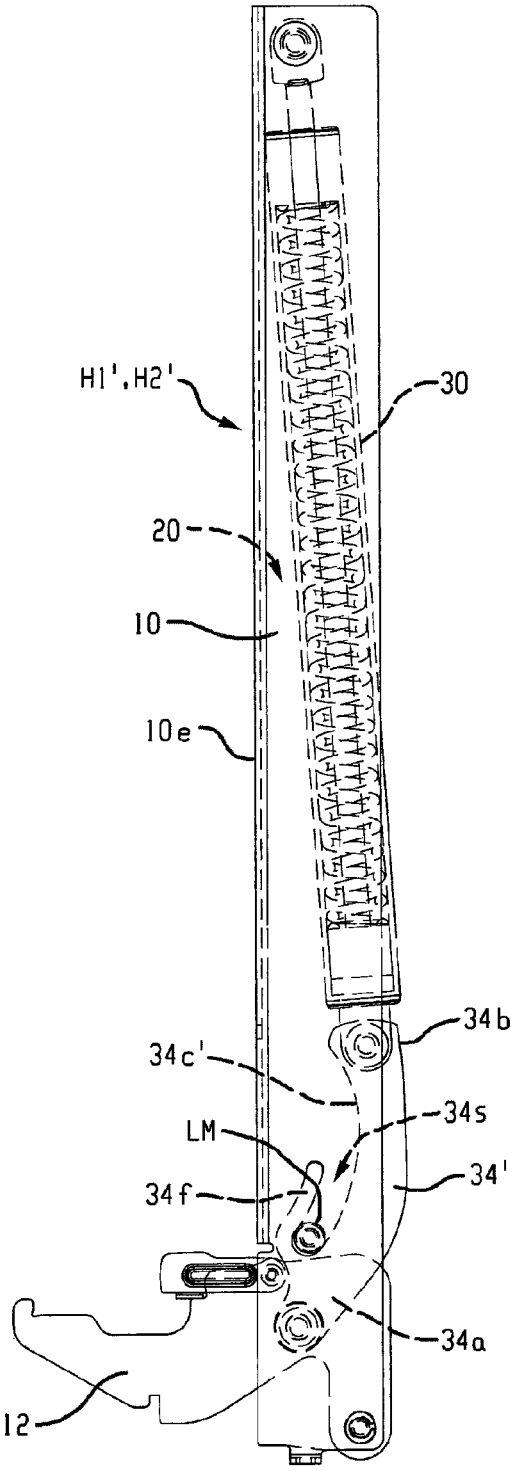
FIG. 4A discloses an alternative damped hinge assembly formed in accordance with the present development.

It should be noted that the damper 30 is captured in the recess 20 by a keeper 22 that is connected to the channel and that extends into or across the recess 20. As shown, the keeper 22 comprises a strip or strap of metal or other suitable material that can be used in the environment of an oven door D extends between the channel side walls 10*a*,10*d* across the recess to capture the damper 30 in the recess 20. The keeper 22 allows limited pivoting movement of the damper 30 in the recess 20 relative to the channel 10 as is required during pivoting movement of the channel 10 between its first and second positions, but prevents undesired movement of the damper 30 out of the recess 20 and prevents movement of the link edge 34*c* away from the link control member LM during movement of the channel 10 from its second (door opened) position to its first (door closed) position. Alternatively, the keeper 22 can act on the second edge 34*d* or other part of the link(s) 34. FIG. 4A shows an alternative hinge assembly H1',H2' in which the keeper 22 is omitted, and the link 34 disclosed above is replaced by a link 34'. The link 34' includes a slot 34*s* in which the link control member LM is located and captured at least when the hinge assembly H1',H2' is located in (and preferably also near) its first operative position such that the link control member LM prevents movement of the link 34' and damper 30 out of recess 20 away from the wall 10*e* of the channel 10 when the hinge assembly H1',H2' is moved from its second operative position toward its first operative position. In the illustrated embodiment, the slot 34*s* is defined between the link edge 34*c*' and a finger 34*f* that projects upwardly from the inner end 34*a* of the link spaced from the edge 34*c*'. The finger 34*f* defines the slot 34*s* to be open at its outer end such that the link control member LM escapes from the slot 34*s* when the hinge assembly H1',H2' is moved partly or fully to its second operative position, i.e., the link control member LM is located in the slot 34*s* only when the hinge assembly H1',H2' in its first operative position or close to its first operative position. In an alternative embodiment, the finger 34*f* is connected at one end to the inner end 34*a* of the link 34' and at its other end to the outer end 34*b* of the link 34' such that the slot 34*s* is closed and captures the link control member LM therein at all times and for all positions of the channel 10 when the hinge assembly H1',H2' is moved to and between its first and second operative positions.

In accordance with one preferred embodiment of the present development, the hinge system H is arranged such that:

one of the hinge assemblies H1,H2 includes an damper 30 that dampens only or at least primarily during closing of the oven door D (upon retraction of the rod 30*b*) as the channel 10 moves from its second position to its first position, with little or no damping during opening of the door D (extension of the rod 30*b*);

the other of the hinge assemblies H1,H2 is oppositely configured to include a damper 30 that dampens only or at least primarily during opening of the oven door D (upon extension of the rod 30*b*) as the channel 10 moves from its first position to its second position, with little or no damping during closing of the door (retracting of the rod 30*b*).

As used herein, the damper 30 is deemed to dampen "primarily" during extension or retraction of the rod 30*b* if the damping is greater in the specified direction of movement of the rod 30*b* and piston 30*c* as compared to the opposite direction of the movement of the rod 30*b* and piston 30*c*. A damper 30 that dampens primarily only in one direction of movement of the piston 30*c* can also be described as an asymmetric damper 30. In the hinge system H, the spring 30*e* can be included in the damper 30 of both hinge assemblies H1,H2 or omitted from either one or both of the hinge assemblies H1,H2, depending upon the amount of desired biasing force for counterbalancing the weight of the oven door D.

Figure 8A:
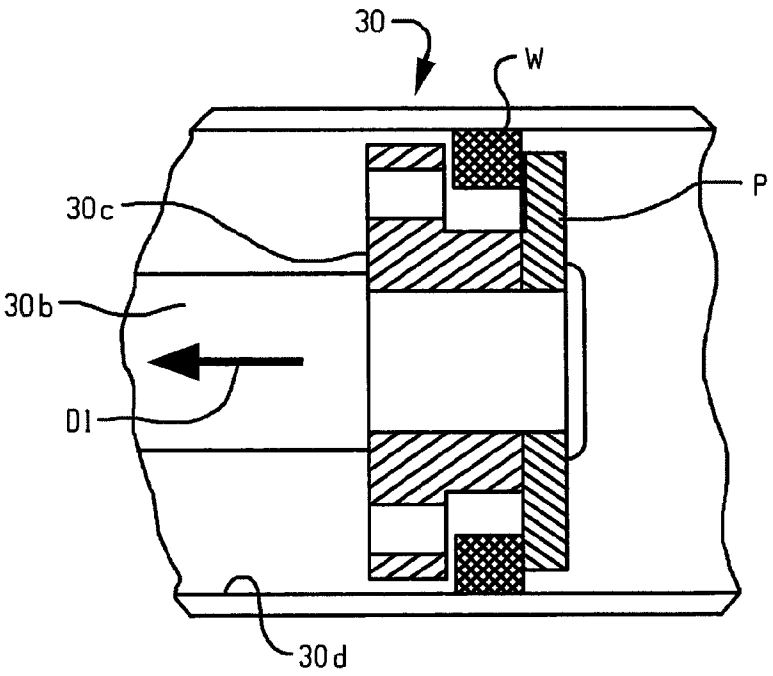
FIGS. 8A and 8B show an example of an asymmetric damper that dampens primarily in one direction.
Figure 8B:
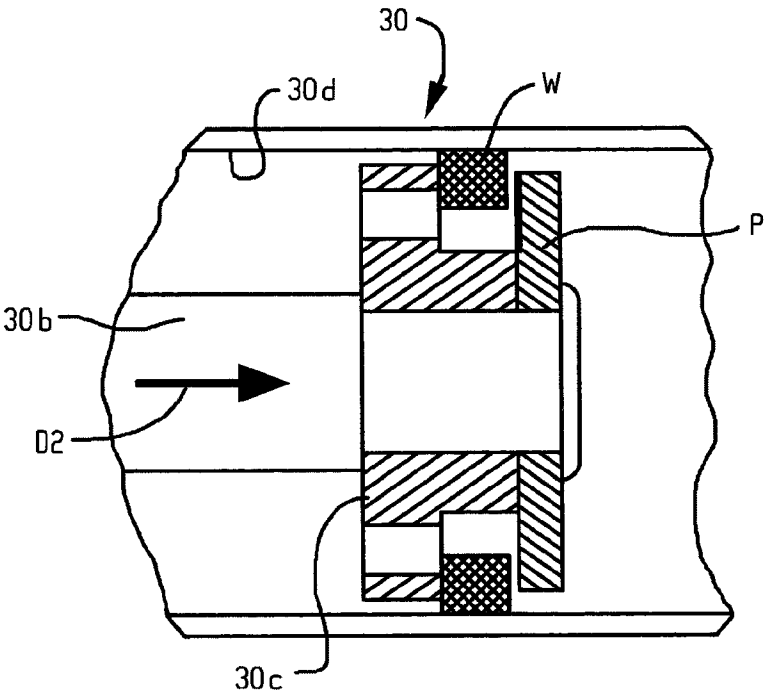

FIGS. 8A and 8B show an example of an asymmetric damper 30 that dampens primarily only in one direction D1, during extension of the rod 30*b* from the bore 30*d*. As shown in FIG. 8A, when the piston 30*c* moves in the direction D1, friction between a washer W that floats on the piston 30*c* and the wall of the bore 30*d* causes the washer W to slide on the piston 30*c* to a position where it abuts a baffle plate P that is connected to or formed as part of the piston, so that the washer W blocks or restricts fluid flow through or around the baffle plate P and causes the damper fluid to be captured on the rod side of the piston 30*c*. Conversely, when the piston 30*c* moves in the opposite direction D2 as shown in FIG. 8B, friction between the washer W and the wall of the bore 30*d* causes the washer W to slide on the piston 30*c* to a position where it is spaced from the baffle plate P to facilitate fluid flow through/around the baffle plate P, such that fluid can flow more freely from one side of the piston 30*c* to the other. FIGS. 8A and 8B show only one example of an asymmetric damper 30, and other structures are contemplated and fall within the scope of the present development.

In one embodiment, the dampers 30 of both of the hinge assemblies H1,H2 can be configured to dampen in the same direction during only opening or closing of the oven door D, or the dampers 30 of both of the hinge assemblies H1,H2 can be configured to dampen in both directions, i.e., during both opening and closing of the oven door D. In another example embodiment, the damper 30 of each hinge assembly is identical and dampens only during extension or retraction of the rod 30*b*, but the respective dampers 30 of the hinge assemblies H1,H2 are installed in the opposite orientation relative to each other such that one of the hinge assemblies H1,H2 dampens primarily only on opening of the oven door D and the other of the hinge assemblies H1,H2 dampens primarily only on closing of the oven door D.

The hinge system H can be configured to allow the oven door D to counterbalance or otherwise be retained in a broil position, where the oven door D is maintained partially opened relative to the cooking chamber C as is sometimes desired when the oven O is operated to broil food. This can be accomplished in a variety of different arrangements such as, e.g., providing a recess or lobe in the first link edge 34*c* for releasably restraining relative movement between the link(s) 34 and the link control member LM when the door D is moved to the desired broil position.

The damper 30 in either or both hinge assemblies H1,H2 can optionally be configured to dampen only during part or parts of the stroke of its rod 30*b* and piston 30*c*, such that a first part of the stroke of the rod 30*b* and piston 30*c* is dampened more than a second part of the stroke of the rod 30*b* and piston 30*c*, whether the damper 30 is configured to dampen during extension and/or retraction of the rod 30*b* and piston 30*c*.

Figure 9:
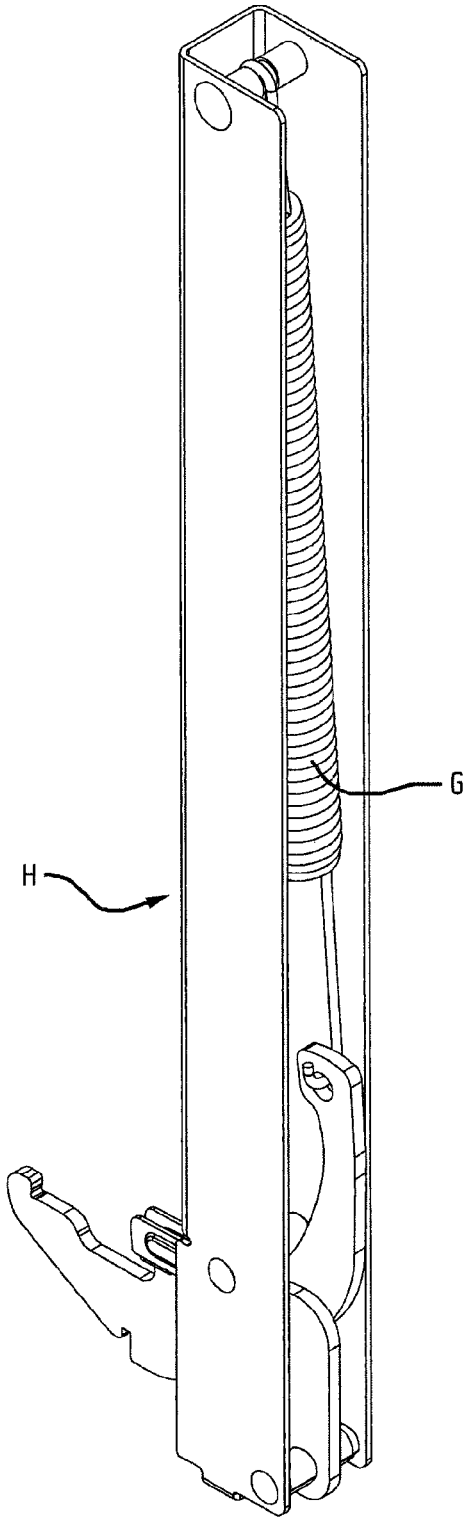
Fig. 9 PRIOR ART
FIG. 9 (prior art) shows a conventional tension coil spring hinge assembly.

In an alternative embodiment, the damper 30 in only one of the hinge assemblies H1,H2 is replaced by a conventional tension coil spring such that only one of the hinge assemblies H1,H2 includes a damper 30. An example of such a conventional tension coil spring hinge assembly including a tension coil spring G is shown at H in FIG. 9.

Other modifications and alterations will occur to those of ordinary skill in the art to which the invention pertains upon reading and understanding this specification. It is intended that the present invention, as defined by claims, be construed as encompassing all such modifications and alterations.

The invention claimed is:

1. An oven comprising:

a body defining a cooking chamber;

first and second hinge assemblies located on respective first and second opposite sides of said body;

a door pivotally connected to said body by said first and second hinge assemblies, said door movable between a closed position where it closes a mouth of said cooking chamber and an opened position where it opens a mouth of the cooking chamber, each hinge assembly comprising a hinge arm and a channel pivotally connected to said hinge arm, said channel defining a recess located between spaced-apart side walls of the channel, wherein the hinge arm of each hinge assembly is connected to said body and the channel of each hinge assembly is connected to said door;

wherein at least one of said first and second hinge assemblies is a damped hinge assembly comprising a damper located in said recess and operatively connected between said channel and said hinge arm, wherein said damper comprises:

a body defining a bore;

a piston slidably received in said bore;

a rod connected to said piston and projecting outward from said bore;

a damper fluid contained in said bore and acting on said piston to dampen sliding movement of said piston in at least one direction in said bore; and, a spring located in said bore and acting on said piston to bias said piston toward one end of said bore;

said damped hinge assembly further comprising a keeper connected to said channel that captures the damper in the recess of said channel, said keeper comprising a strap that is connected to both of said spaced-apart side walls of said channel and that extends across said recess to capture said damper body in said recess.

2. The oven as set forth in claim 1, wherein said damper is an asymmetric damper in which said damper fluid dampens movement of said piston primarily in one direction.

3. The oven as set forth in claim 2, wherein said one direction is a direction in which said piston moves outwardly away from an inner end of said bore, and wherein said spring biases said piston toward said inner end of said bore.

4. The oven as set forth in claim 2, wherein said one direction is a direction in which said piston moves inwardly toward an inner end of said bore, and wherein said spring biases said piston toward said outer end of said bore.

5. The oven as set forth in claim 1, wherein said body of said damper is connected to said hinge arm and said rod of said damper is connected to said channel.

6. The oven as set forth in claim 5, wherein said damped hinge assembly comprises at least one link that connects said body of said damper to said hinge arm, wherein an inner end of said link is connected to said hinge arm and an outer end of said link is connected to said body of said damper.

7. The oven as set forth in claim 1, wherein said rod of said damper is connected to said hinge arm and said body of said damper is connected to said channel.

8. The oven as set forth in claim 7, wherein said damped hinge assembly comprises at least one link that connects said rod of said damper to said hinge arm, wherein an inner end of said link is connected to said hinge arm and an outer end of said link is connected to said rod of said damper.

9. The oven as set forth in claim 1, wherein said damped hinge assembly further comprises at least one link that connects said damper to said hinge arm, wherein an inner end of said link is connected to said hinge arm and an outer end of said link is connected to said damper.

10. The oven as set forth in claim 9, wherein said damped hinge assembly further comprises a link control member connected to the channel, wherein a first edge of the link contacts said link control member when said channel pivots relative to said hinge arm.

11. The oven as set forth in claim 10, wherein said damped hinge assembly further comprises a first fastener that pivotally connects said channel to said hinge arm, and wherein a second edge of said link, opposite said first edge, abuts said first fastener when said oven door is located in its opened position such that said first fastener defines a stop.

12. The oven as set forth in claim 9, wherein said damped hinge assembly further comprises a first fastener that pivotally connects said channel to said hinge arm, and wherein said link abuts said first fastener when said oven door is located in its opened position such that said first fastener defines a stop.

13. The oven as set forth in claim 1, wherein both said first and second hinge assemblies are damped hinge assemblies.

14. The oven as set forth in claim 13, wherein:

one of the first and second hinge assemblies dampens sliding movement of its respective piston primarily during closing of the oven door; and, the other of the first and second hinge assemblies dampens sliding movement of its respective piston primarily during opening of the oven door.

15. The oven as set forth in claim 14, wherein the respective dampers of the first and second hinge assemblies comprise the same structure as compared to each other and are installed in the respective first and second hinge assemblies with an opposite orientation.

16. The oven as set forth in claim 9, wherein said damped hinge assembly further comprises a link control member connected to the channel, and wherein said link comprises a slot in which said link control member is located for at least one position of said channel relative to said hinge arm.

17. A damped hinge assembly comprising:

a hinge arm adapted to be connected to an associated appliance body;

a channel pivotally connected to said hinge arm and adapted to be connected to an associated appliance door, said channel defining a recess;

a damper operatively connected between said channel and said hinge arm, said damper comprising:

a body defining a bore;

a piston slidably received in said bore;

a rod connected to said piston and projecting outward from said bore;

a damper fluid contained in said bore and acting on said piston to dampen sliding movement of said piston in at least one direction in said bore; and, a spring located in said bore and acting on said piston to bias said piston toward one end of said bore;

said damper located in a recess defined between spaced-apart side walls of the channel, said damped hinge assembly further comprising a keeper connected to said channel that retains the damper in the recess, said keeper comprising a strap that is connected to both of said spaced-apart side walls and that extends across said recess to capture said damper in said recess.

18. The hinge assembly as set forth in claim 17, wherein said damper is an asymmetric damper in which said damper fluid dampens movement of said piston primarily in one direction.

19. The hinge assembly as set forth in claim 18, wherein said one direction is a direction in which said piston moves outwardly away from an inner end of said bore, and wherein said spring biases said piston toward said inner end of said bore.

20. The hinge assembly as set forth in claim 18, wherein said one direction is a direction in which said piston moves inwardly toward an inner end of said bore, and wherein said spring biases said piston toward said outer end of said bore.

21. The hinge assembly as set forth in claim 17, wherein said body of said damper is connected to said hinge arm and said rod of said damper is connected to said channel.

22. The hinge assembly as set forth in claim 21, further comprising at least one link that connects said body of said damper to said hinge arm, wherein an inner end of said link is connected to said hinge arm and an outer end of said link is connected to said body of said damper.

23. The hinge assembly as set forth in claim 17, wherein said rod of said damper is connected to said hinge arm and said body of said damper is connected to said channel.

24. The hinge assembly as set forth in claim 23, further comprising at least one link that connects said rod of said damper to said hinge arm, wherein an inner end of said link is connected to said hinge arm and an outer end of said link is connected to said rod.

25. The hinge assembly as set forth in claim 17, further comprising at least one link that connects said damper to said hinge arm, wherein an inner end of said link is connected to said hinge arm and an outer end of said link is connected to said damper.

26. The hinge assembly as set forth in claim 25, further comprising a link control member connected to the channel, wherein a first edge of the link contacts said link control member when said channel pivots relative to said hinge arm.

27. The hinge assembly as set forth in claim 26, further comprising a first fastener that pivotally connects said channel to said hinge arm, wherein a second edge of said link, opposite said first edge, abuts said first fastener upon said channel being pivoted from a first position to a second position relative to said hinge arm such that said first fastener defines a stop for said second position.

28. The hinge assembly as set forth in claim 25, further comprising a first fastener that pivotally connects said channel to said hinge arm, wherein said link abuts said first fastener upon said channel being pivoted from a first position to a second position relative to said hinge arm such that said first fastener defines a stop for said second position.

29. The hinge assembly as set forth in claim 17, further comprising a link control member connected to the channel, wherein said link comprises a slot in which said link control member is located for at least some positions of said channel relative to said hinge arm to capture said link relative to said channel.

30. An appliance comprising:

a body defining a chamber;

first and second hinge assemblies located on respective first and second opposite sides of said body;

a door pivotally connected to said body by said first and second hinge assemblies, said door movable between a closed position where it closes a mouth of said chamber and an opened position where it opens a mouth of the chamber, each hinge assembly comprising a hinge arm and a channel pivotally connected to said hinge arm, wherein the hinge arm of each hinge assembly is connected to said body and the channel of each hinge assembly is connected to said door;

wherein said first and second hinge assemblies are damped hinge assemblies each comprising a damper operatively connected between its channel and its hinge arm, wherein said damper comprises a body defining a bore, a piston slidably received in said bore, a rod connected to said piston and projecting outward from said bore, and a damper fluid contained in said bore and acting on said piston to dampen sliding movement of said piston in said bore;

said damper of said first damped hinge assembly configured to dampen sliding movement of said piston thereof primarily in a first direction for at least part of a stroke of said piston in said first direction, wherein said first direction corresponds to movement of said door from said closed position toward said opened position; and said damper of said second damped hinge assembly configured to dampen sliding movement of said piston thereof primarily in a second direction for at least part of a stroke of said piston in said second direction, wherein said second direction corresponds to movement of said door from said opened position toward said closed position, said damper of said second damped hinge assembly located in a recess defined between spaced-apart side walls of the channel, said second damped hinge assembly further comprising a keeper connected to said channel that retains the damper in the recess, said keeper comprising a strap that is connected to both of said spaced-apart side walls and that extends across said recess to capture said damper in said recess.

* * * * *